United States Patent [19]

Trummer

[11] Patent Number: 4,619,421

[45] Date of Patent: Oct. 28, 1986

[54] SENSOR ARRANGEMENT IN A SEARCH HEAD

[75] Inventor: Gunther Trummer, Baiersdorf, Fed. Rep. of Germany

[73] Assignee: Diehl GmbH & Co., Nuremberg, Fed. Rep. of Germany

[21] Appl. No.: 669,105

[22] Filed: Nov. 7, 1984

[30] Foreign Application Priority Data

Nov. 26, 1983 [DE] Fed. Rep. of Germany ..... 3342958

[51] Int. Cl.[4] ..... F41G 7/26

[52] U.S. Cl. ..... 244/3.16

[58] Field of Search ..... 244/3.15, 3.16, 3.19, 244/3.2; 74/5 R, 5.22

[56] References Cited

U.S. PATENT DOCUMENTS 4,085,910 4/1978 Baker et al. ..... 244/3.16
4,339,097 7/1982 Kordulla et al. ..... 244/3.16
4,558,325 12/1985 Ström ..... 244/3.16

FOREIGN PATENT DOCUMENTS 79684 5/1983 European Pat. Off. .
1539581 1/1979 United Kingdom .

*Primary Examiner*—Charles T. Jordan
*Attorney, Agent, or Firm*—Scully, Scott, Murphy and Presser

[57] ABSTRACT

A sensor arrangement in a tracking or search head which is equipped with a two-axis cardan frame system for the movements of a sensor relative to the search head. In the sensor arrangement of the above constructive type, the cardan frame system and the sensor which is axially offset ahead thereof, are supported by paired spherical surfaces which are passed through by a spine passageway and are interconnected through the intermediary of a parallelogram linkage.

10 Claims, 2 Drawing Figures

SENSOR ARRANGEMENT IN A SEARCH HEAD

BACKGROUND OF THE INVENTION

1. Field of the Invention

The present invention relates to a sensor arrangement in a tracking or search head which is equipped with a two-axis cardan frame system for the movements of a sensor relative to the search head.

2. Discussion of the Prior Art

A sensor arrangement of that type has become known from the disclosure of published European Patent Application 79 684. In that instance, the sensor is built into the inner frame of a cardan frame system in order to be able to be pivoted about two orthogonal axes relative to the search head. However, this integral compact structure leads to a complex construction with relatively large radial dimensions for the sensor arrangement, which necessitates considerably extensive manufacturing requirements, and is difficult to service in the event of failures. Hereby, a manufacture in the type of subcomponents which can be independently tested during the course of assembly is not possible. Furthermore, in these usual constructions (pursuant to the socalled principle of the uncontrolled gyroscope) there must be moved large masses, inasmuch as during the search phase, there must be pivoted, within the search head, the gyroscope rotor of the spin gyroscope together with the components of the sensor which are mounted thereon, which then causes adverse kinetic problems. Furthermore, there must also be considered as being disadvantageous that a sensor arrangement of that type is not applicable to certain high performance-capable ammunition in a projectile search head which possesses a warhead with a hollow charge, which necessitates the provision of an undisrupted axial passageway through the search head for the effective formation of the hollow charge point or spine subsequent to the detonation of the warhead.

SUMMARY OF THE INVENTION

In recognition of these conditions, the present invention has as its object to provide a sensor arrangement of the above-mentioned constructional type, which does not generate any problems with regard to projectiles with suitable warheads, and thereby can also be especially utilized with such warheads which possess a hollow charge insert and which thereby require a spine passageway extending through the search head.

The foregoing object is inventively achieved in that in the sensor arrangement of the above constructive type, the cardan frame system and the sensor which is axially offset ahead thereof, are supported by paired spherical surfaces which are passed through by a spine passageway and are interconnected through the intermediary of a parallelogram linkage.

The foregoing construction thus makes use of the fact that adequate installation space is available in the search head in the direction of the longitudinal axis of the projectile whereby, on the one hand, the cardan frame system and on the other hand, the actual sensor can be arranged axially offset with regard to each other, and wherein the movable coupling can be effected by means of an articulated connection externally of the spine passageway. Through this axial offset between the cardan frame system and the actual sensor, there is obtained an uncomplicatedly producible and readily serviceable construction and, in particular, a completely mechanically stable and thereby functionally-dependent arrangement, inasmuch as the masses of the cardan frame system are supported for unrestricted pivoting independently of the masses of the sensor in the search head, and thereby the acceleration forces due to firing can be supported against large-sized surface areas along spherical surfaces. Through the displacement of the sensor support externally of the cardan frame system, smaller radial dimensions for the sensor arrangement are obtained therefrom; in effect, there is achieved the construction of a slender search head for projectiles of comparatively small caliber without having to, in any manner, climinate any target searching and target tracking functions from the search head. The internal space of the cardan frame system which is now freed of the sensor, stands available for the undisrupted formation of the spine-like hollow charge passageway.

In addition thereto, a construction of the spin gyroscope independently of the frame system for the sensor movement, also facilitates the provision of a readily serviceable system structure from clearly separated subcomponents in the form of operationally independent subsystems. The small-sized construction of the spin gyroscope which is facilitated thereby provides for small rotating masses and allows for the pivoting drive of the components of the frame system at the largest angular velocities through elements (socalled torque motors) possessing, in turn, low inertial masses.

It is particularly suitable to construct the kinetic coupling between the cardan frame system and the sensor through a parallelogram linkage which merely consists of tension-loaded loaded coupling rods with ball bearing joints at the end surfaces. Thereby, the adjustment in length of the coupling rods is not critical, inasmuch as there is not provided any correlation in the mechanical degrees of freedom; and especially during the firing acceleration of a projectile which is equipped with such a search head, there is no pressure transmission from the sensor to the cardan frame system which, otherwise, could lead to operational disruptions, in any case at the beginning of operation, immediately subsequent to the firing.

BRIEF DESCRIPTION OF THE DRAWINGS

Additional modifications and alternative constructions, as well as further features and advantages of invention can be ascertained from the following detailed description of a generally schematically illustrated exemplary embodiment, taken in conjunction with the accompanying drawings; in which.

DETAILED DESCRIPTION

Figure 1:
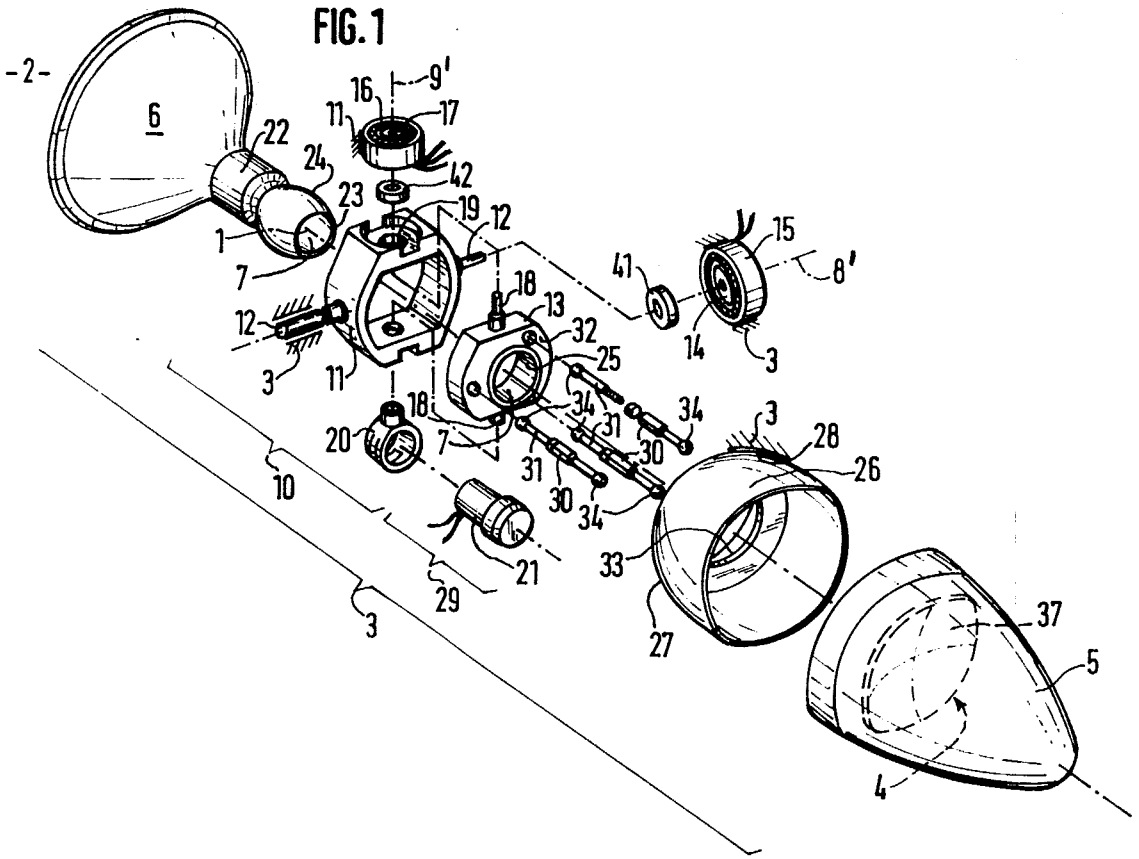
FIG. 1 illustrates a perspective exploded view of the sensor arrangement in a search head located ahead of the warhead in a projectile (represented with transverse axes offset by 90° about the longitudinal axis)

Located ahead of the warhead 2 of a projectile, is a search head 3 with a sensor 4 essentially axially symmetrical relative to the longitudinal axis 1 of the projectile, and behind an aerodynamic flow profile-shaped front radar dome 5. The warhead 2 is equipped with a hollow charge (not shown) of which an inverse conical surface 6 complementary to the hollow charge insert forms a transition into a spine passageway 7. This passageway extends through the search head 3 up to at least the sensor 4, in accordance with the configuration thereof also possibly therethrough, so as to ensure that subsequent to the detonation of the warhead 2 there is obtained an undisturbed formation of the hollow charge spine or point, and thereby the optimum combat effect within a target.

The projectile moves spatially stable subsequent to a predetermined starting and stabilizing phase; in essence, with a yaw axis 8 essentially fixedly oriented in space, and perpendicular thereto, a pitch axis 9 oriented horizontally in space. During a target searching phase, the sensor 4 meanderingly scans the target area while forwardly inclined, in that it is alternatively pivoted towards the left and right at a certain angle (in the magnitude of about ± a few 10°) about the forward direction of the longitudinal axis 1. In order that, notwithstanding the forward movement of the projectile, in effect the sensor 4, there is obtained above the target area a scanning path thereof which extends at a right angle relative to the direction of movement of the projectile, the transverse pivoting of the sensor 4 must have superimposed thereon a pitch movement (in the magnitude of 10% of the yaw angle from an initial angular position downwardly), which at the end of each yaw movement again springs back into the initial pitch angle position. However, with this construction of the sensor arrangement in the search head 3 there can also be implemented other suitable modes of search phases without any kind of constructive changes, merely through the actuation of control elements 15, 16 (see below), such as circular, spiral or raster scanning of the search region within the target area.

For this defined, controlled implementation of such two-axis, superimposed movements of the sensor and relative to the search head 3, built into the latter is a two-axis cardan frame system 10. The outer, and thereby larger frame 11, is supported within the search head 3 so as to be pivotable about the yaw axis 8', inasmuch as due to its larger external dimensions it can be dimensioned with stable dimensionable bearing trunnions 12, it can be dimensioned in correlation with the larger extent of movement and the larger masses which are to be moved (in the form of the inner frame 13). The yaw movement of the cardan frame system 10 is effected through the drive of the outer frame 11 by means of a yaw control element 15 which is secured with its rotor 14 fixed against rotation to a yaw bearing trunnion 12 stationarily supported in the search head 3, for example, in the form of a rotor transmitter or a torque motor. The control of such a torque motor is effected in a known manner through a position sensor 41 (for example, a potentiometer) which is directly connected therewith; in effect located on the same drive trunnion 12.

Interiorly of the outer frame 11, the inner frame 13 is supported for pivoting about its pitch axis 9' which, similar to the yaw axis 8', is oriented at a right angle to the longitudinal axis 1 of the search head, and additionally, at a right angle to the yaw axis 8'. A yaw control element 16 which is equipped with a position sensor 42, and which is rigidly connected with the outer frame 11, acts with its rotor 11 secured against rotation on a yaw bearing trunnion 18 which passes through a bearing bore 19 concentrically with the pitch axis 9' in the outer frame 11. This, or another pitch bearing trunnion 18 further carries a connector element 20 for the movement-secured coupling of a spin gyro 21 with the inner frame 13.

The spin gyro 21 serves as a sensor for the positional change and thereby for the momentary position of the cardan frame system 10, and as a result, as disclosed hereinbelow, that of the sensor 4, relative to the warhead 2 and thus relative to the longitudinal axis 1 of the projectile, in order to recover directional information over the momentary position of the sensor 4 and thus, as required, over the location of a target object which has been detected by the sensor 4, and to be able to convert these into control information for the target approach (not shown in the drawing).

The assembly consisting of the two outer and inner frames 11, 13 together with their control elements 15, 16 and the positioned gyro 21, is supported on a conduit 22 ahead of the warhead complementary conical surface 6. For this purpose, on the free end 23 of the conduit which extends into the search head 3, there is formed a cup-shaped spherical shell surface 24 which is passed through by the barb passageway 7, which extends into the inner frame 13. Formed therein as a seat, is a complementary dimensioned hollow-spherical inner surface 25, which is rearwardly hollow-cylindrically widened, towards the warhead 2, for the axial insertion of the conduit end 23 of the spherical shell surface 24. Thereby, the complete cardan frame system 10 is supported on the spherical conduit end 23 for pivoting in all spatial directions; whereby the rearward engagement of the spherical shell surface 24 into the inner frame 13 opposite to the hollow spherical inner surface 25 against the direction of movement of the projectile, leads to a largesurfaced and thereby stable support for the large acceleration forces which are generated during projectile firing.

Independently of the cardan frame system 10, within the search head 3 there is supported the sensor 4 so as to be pivotable about two transverse yaw and pitch axes 8, 9; in effect, coaxially ahead of the cardan frame system 10 within a flush ring 26 with a spherical outer support surface 27, which is radially supported against a hollow spherically-shaped guide surface 28 fixed in the search head 3, and supported axially against the direction of movement of the projectile. The sensor 4 can relate to an active or a passive navigation system which is based on electromagnetic energy (in the microwave or millimeter wavelength, or in the infared spectral range) which, as above-described, will scan a search region during overflight of the target area. Upon the detection of a target object, the scanning-pivot control of the sensor 4 is switched over in a known manner to a target tracking mode, with therefrom obtained control information for pivoting the flight direction (longitudinal axis 1) of the projectile from the previous searching flight path into a target approach trajectory.

The actuation of the cardan frame system 10 by means of the control elements 15, 16 also serves, during the operating phase of the scanning of the target area for target searching, for the periodic pivoting of the sensor 4 about the yaw and pitch axes 8, 9; whereas thereafter, during the target tracking phase, the current momentary position of the sensor relative to the search head and thereby the warhead 2, is determined through the cardan frame system 10 by the spin gyro 21 and the position sensors 41, 42.

The positioning and motion coupling between the cardan frame system 10 and the sensor 4, which is supported independently thereof and axially offset relative thereto, is effected through a drive-transmissive coupling in the type of (not angle-stabilized) parallelogram linkage 29 externally of the spine passageway 7. For this purpose, at least one coupling rod 31 which can be adjusted lengthwise by means of a collet 30 is articulated between the (in the flight direction) forward face 32 of the inner frame 13 and the rearward face 33 of the sensor flush ring 26, for example, by means of ball bearing joint 34. Basically, two coupling rods 31 of that type are adequate for the defined transmission of the spatial movement of the inner frame 13 on the sensor 4, inasmuch as the centerpoint of the movement of the frame inner surface 25 or, respectively, the sensor support surface 27 on the longitudinal axis 1 of the search head represents the third required geometric boundary condition; insofar as the coupling rods 31 merely serve for the movement and positional transmission between the cardan frame system 10 and the sensor 4, and because of the axial support opposite the spherical shell surface 24 or, respectively, the support ring guide surface 28 axial forces need to be transmitted opposite to the direction of flight.

However, it would be more suitable, as illustrated, to articulate or hinge three coupling rods 31 symmetrically relative to the longitudinal axis 1, so as even under unfavorable operating conditions ensure a tipping-free motion transmission between the cardan frame system 10 and the sensor 4.

Figure 2:
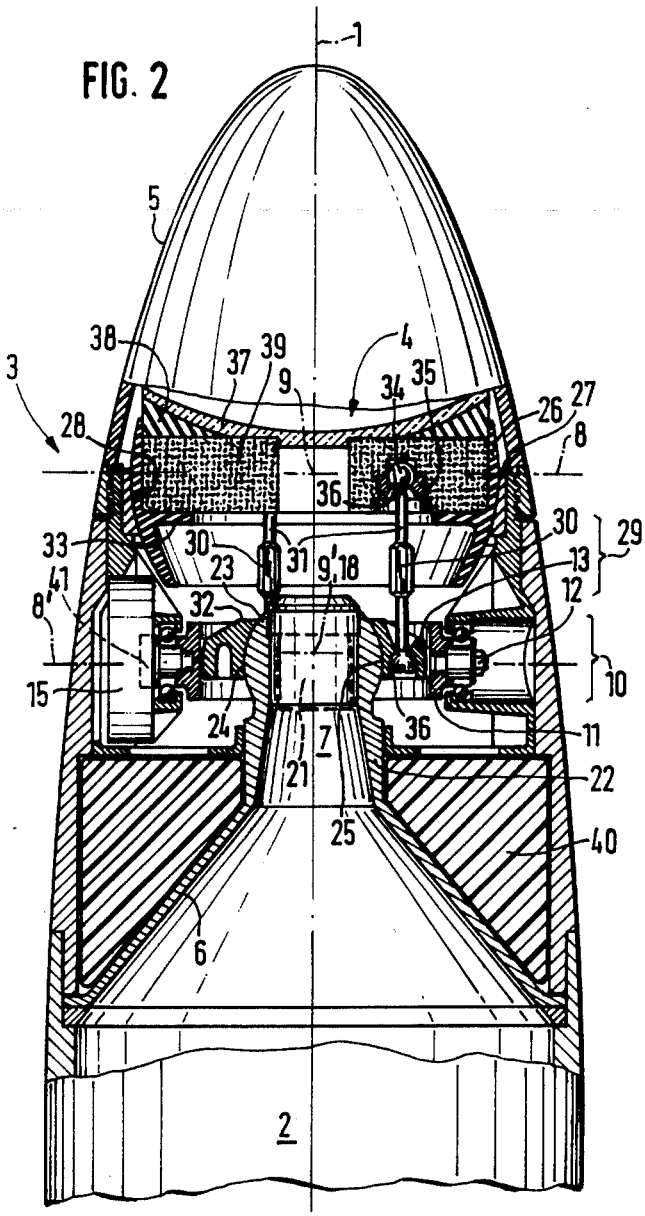
FIG. 2 illustrates the search head assembled ahead of the warhead, shown in a longitudinal section taken along the yaw axis.

As can be ascertained from the longitudinal sectional view through the yaw axis 8 in FIG. 2, it is adequate to exert on only one of the ball bearing joints 34 of each coupling rod 31, pressure as well as tension, in that; for example, it is engaged from behind thereof by clamping nut 35. The oppositely located ball bearing joint 34 of the applicable coupling rod 31 need then be merely, opposite to the forward face 32, introduced into its receiving bore 36 and be connected by means of the collet 30 to the structure of the parallelogram linkage 29, since by means of the applicable coupling rod 31 (in the illustrated embodiment according to FIG. 2; for return movement opposite the direction of flight of the projectile), no pressure force need to be transmitted; inasmuch as the rearward movement is produced through the pulling movement of a coupling rod 31 which is located on the other side of the longitudinal axis 1.

As can similarly be ascertained from the longitudinal sectional view in FIG. 2, sufficient mounting space is available beneath the radar dome 5 ahead of the sensor flush ring 26 for the axially-symmetrical construction of the sensor 4. Herein, utilizable as sensor antennas for the target search by means of radar or radiometric systems are all available types (such as, for instance, parabolic, cassegrain, or planar antennas); in the utilization of infared systems there can be here inserted applicable mirror combinations. For example, in the case of metallic vapor-deposition coating of a thin plastic material shell 38, the ammunition-technology utilizing effect of the hollow charge of the warhead 2 will not be disturbed when, for example, a parabolic mirror 37 extends over the forward opening of the spine passageway 7. Between the antenna and the engagement of the coupling rod-ball bearing joint 34 into the flush ring 26, there is available mounting space for the receiver or transmitter unit 39; while further electronic circuits 40 for signal processing and control parameter pickup can be arranged in the annular space about the complementary conical surface 6.

Employable as the spin gyro 21 can be the magnetohydrodynamic sensor "GG 2500" manufactured by the company Honeywell. As the yaw and pitch control elements 15, 16 there can be directly utilized the direct current-servo motors manufactured by the company Magnetic Technology Canoga Park, Calif.

What is claimed is:

1. In a sensor arrangement within a search head, including a two-axis cardan frame system on said search head for effecting the movements of a sensor relative to the search head; the improvement comprising said sensor being axially offset ahead of said cardan frame system; paired spherical surface members supporting said frame system and sensor, said spherical surface members being extended through by a spine passageway; and a parallelogram linkage interconnecting said sensor and said cardan frame system.

2. A sensor arrangement as claimed in claim 1, wherein an outer frame of the cardan frame system is pivotably supported in said search head about the axis of the larger pivoting movement of the sensor.

3. A sensor arrangement as claimed in claim 2, wherein the parallelogram linkage extends intermediate an inner frame of the cardan frame system and a flush support ring for the sensor.

4. A sensor arrangement as claimed in claim 3, wherein control elements and position sensors for the frame axes, and a spin gyro are arranged on the outer sides of the cardan frame system.

5. A sensor arrangement as claimed in claim 4, wherein the spin gyro is rigidly connected with the inner frame of said cardan frame system.

6. A sensor arrangement as claimed in claim 3, including a spine passageway conduit extending into the search head, the conduit having a shell surface in the region of the forward end formed as a spherical surface which axially engages into the inner frame of the cardan frame system and is supported therein axially in the forward direction of the search head and radially against an internal hollow spherical surface.

7. A sensor arrangement as claimed in claim 1, in which the sensor is retained with a flush support ring, said ring having a shell surface formed as a spherical guide surface which is supported axially opposite the forward direction of the search head and radially against a support surface formed on the search head.

8. A sensor arrangement as claimed in claim 1, wherein the parallelogram linkage comprises of at least two coupling rods located externally of the spine passageway, said coupling rods having ball joints at the ends thereof.

9. A sensor arrangement as claimed in claim 8, where one said ball joint only one each coupling rod is subjected to tension and pressure.

10. A sensor arrangement as claimed in claim 1, wherein the parallelogram linkage includes coupling rods which are adjustable in length.

* * * * *